US012049749B2

(12) United States Patent
Alexander

(10) Patent No.: US 12,049,749 B2
(45) Date of Patent: Jul. 30, 2024

(54) MODULE FOR DRAINAGE AND METHOD OF ASSEMBLY

(71) Applicant: Southern Geosynthetics Supplies Pty Ltd, Montmorency (AU)

(72) Inventor: Wayne Stephen Alexander, Eltham (AU)

(73) Assignee: SOUTHERN GEOSYNTHETICS SUPPLIES PTY LTD, Montmorency (AU)

( * ) Notice: Subject to any disclaimer, the term of this patent is extended or adjusted under 35 U.S.C. 154(b) by 140 days.

(21) Appl. No.: 17/629,282

(22) PCT Filed: Jul. 24, 2020

(86) PCT No.: PCT/AU2020/050761
§ 371 (c)(1),
(2) Date: Jan. 21, 2022

(87) PCT Pub. No.: WO2021/012016
PCT Pub. Date: Jan. 28, 2021

(65) Prior Publication Data

US 2022/0243447 A1 Aug. 4, 2022

(30) Foreign Application Priority Data

Jul. 25, 2019 (AU) ..... 2019902654

(51) Int. Cl.
*E03F 1/00* (2006.01)
*E02B 11/00* (2006.01)
*E03F 5/10* (2006.01)

(52) U.S. Cl.
CPC ..... *E03F 1/005* (2013.01); *E02B 11/00* (2013.01); *E03F 5/101* (2013.01); *E03F 5/106* (2013.01)

(58) Field of Classification Search
CPC ... E03F 1/00; E03F 1/002; E03F 1/003; E03F 1/005
See application file for complete search history.

(56) References Cited

U.S. PATENT DOCUMENTS 6,779,946 B1 * 8/2004 Urriola ..... E01C 11/228 405/36
7,677,835 B2 * 3/2010 Oscar ..... B65D 90/027 405/39

(Continued)

FOREIGN PATENT DOCUMENTS

AU 2003204302 B2 * 2/2006 ..... A01G 9/033
AU 2003204302 B2 2/2006

(Continued)

*Primary Examiner* — Frederick L Lagman
(74) *Attorney, Agent, or Firm* — Endurance Law Group PLC

(57) ABSTRACT

The invention provides a modular unit or module (20) for use in an underground water management system. The modular unit or module (20) comprises a prism structure being a polyhedron enclosing a pair of internal members (6, 6'). The internal members (6, 6') comprise a first member (6) comprising a first arch (9), and a second member (6') comprising a second arch (9') located at an angle to and being arranged inverted with respect to the first arch (9). The invention also provides a modular system (100) for use in underground water management, the modular system (100) comprising a plurality of the modules or modular units (20, 20').

24 Claims, 8 Drawing Sheets

(56) References Cited

U.S. PATENT DOCUMENTS

| | | | | |
|---|---|---|---|---|
| 8,360,100 | B2 * | 1/2013 | Burkhart, Sr. | E03F 1/003 210/170.03 |
| 9,593,783 | B2 * | 3/2017 | Parker | E02D 31/02 |
| 10,415,225 | B2 * | 9/2019 | Zarraonandia | E03F 5/101 |
| 2007/0186499 | A1 | 8/2007 | Marshall | |
| 2009/0279953 | A1 * | 11/2009 | Allard | E03F 1/005 405/39 |
| 2014/0105684 | A1 * | 4/2014 | Allard | E02B 11/00 405/52 |
| 2014/0291221 | A1 * | 10/2014 | Adams | E03F 3/046 210/170.03 |
| 2018/0030712 | A1 * | 2/2018 | Kent | E03F 1/005 |

FOREIGN PATENT DOCUMENTS

| | | | | |
|---|---|---|---|---|
| CA | 2581624 | A1 | 9/2007 | |
| CN | 104066902 | A * | 9/2014 | E03F 1/00 |
| JP | H08165698 | A | 6/1996 | |
| KR | 101052857 | B1 * | 7/2011 | |
| KR | 20110106226 | A * | 9/2011 | |
| KR | 20180106747 | A * | 10/2018 | |

* cited by examiner

MODULE FOR DRAINAGE AND METHOD OF ASSEMBLY

FIELD OF INVENTION

The present invention relates to the field of underground water management and/or drainage management. More particularly, the invention relates to modular units, component parts thereof, and assemblies of modular units that are useful for managing underground drainage.

In one particular application, for example, the invention may be employed for managing storm-water runoff and/or drainage. In another application, the invention may be employed for creating voids in soil, particularly under landscape structures to provide room for tree roots and/or underground infrastructure, such as drainage pipes.

It will be convenient to hereinafter describe the invention in relation to water drainage and/or water runoff management. However, it should be appreciated that the present invention is not limited to that use only and can be used for multiple purposes in civil and landscape construction.

BACKGROUND ART

It is to be appreciated that any discussion of documents, devices, acts or knowledge in this specification is included to explain the context of the present invention. Further, the discussion throughout this specification comes about due to the realisation of the inventor and/or the identification of certain related art problems by the inventor. Moreover, any discussion of material such as documents, devices, acts or knowledge in this specification is included to explain the context of the invention in terms of the inventor's knowledge and experience and, accordingly, any such discussion should not be taken as an admission that any of the material forms part of the prior art base or the common general knowledge in the relevant art in Australia, or elsewhere, on or before the priority date of the disclosure and claims herein.

Civil and landscape construction require assembly of structures below ground level that complement the structures and landscape design above ground level. For example, the traditional compacted rock and soil mix used to support pavements does not allow for tree root growth under the pavement, or adequate water drainage. Over time, tree roots can force their way through the compacted rock and soil, raising and/or breaking up the pavement.

In addition, many building and land use regulators require landscapers, builders and developers to install underground water management systems to mitigate stormwater flows, preserve land, minimise soil erosion, and protect water resources by ensuring effective flow of water into and across the developed land. To this end, modular units have been developed for installation underground to assist this water management. The modular units are constructed with appropriate strength to support the load of above ground structures, such as pavements, garden structures, and play equipment. To help manage these issues, therefore, the modular units are installed under structures such as pavements. The modules are often generally cubic or polygonal to facilitate interlocking of modules to form a larger, continuous structure. Some are constructed to form tanks or reservoirs for the detention of water runoff. Other modules have a skeletal structure for enclosing large volumes of un-compacted soil to allow unhindered root growth.

US Patent Publication No. US 2009/0279953 A1 (Allard et al) describes known modular units for use in underground water management systems. Each unit has a cubic structure, comprising six square faces. Each face has a circular opening and the upper and lower faces may be covered by a flat panel, while the openings in the side faces may be covered by respective circular panels. The interior of the module may be hollow or have internal elements, such as filters or pipes, for managing water within the assembly of modular units.

Other units of this type are known and include those sold in association with brands such as Rainsmart Ellipse™, Nero™, Terravault™, Stratacell™, Stratavault™, ADS Stormtech™, Atlantis™. Many of these known units are of unitary construction and are designed to be purchased and used as manufactured.

SUMMARY OF INVENTION

It would be desirable to substantially overcome or at least ameliorate one or more of the drawbacks of known systems or at least to provide a useful alternative. For example, it would be desirable to provide a module that is designed or suitable for water management and/or drainage having improved ease of assembly or ease of installation. It would also be desirable to provide such a module that can provide more flexibility or more options in the design of drainage systems.

According to one aspect, the invention provides a modular unit or "module" for an underground water management system, the modular unit comprising a polyhedral prism structure which encloses or encompasses at least two internal support members, wherein the internal support members comprise a first member having a first U-shaped profile and a second member having a second U-shaped profile, and wherein the first member and the second member are arranged such that one of the first U-shaped profile and the second U-shaped profile is inverted with respect to the other. In this regard, the internal support members preferably extend between a base of the prism structure and a top of the prism structure to bear and/or transmit load through the prism structure.

In a preferred embodiment, one of the first U-shaped profile and the second U-shaped profile is configured and arranged as an arch (i.e. an inverted U-shape) and the other of the first and second U-shaped profiles is configured and arranged as an inverted arch. In the context of the present invention, it will be understood that the reference to a "U-shaped" profile or an "arch" refers generally to a shape having a pair of elements (e.g. elongate elements, such as legs, arms, pillars or stems), ends of which are which are interconnected or joined with one another to form a span between those elements. For the purposes of this description and the appended claims, the "U-shaped" profile and/or the "arch" may be curved, rounded, square, or even V-shaped.

In a preferred embodiment, the first U-shaped profile and second U-shaped profile span or extend in planes which are angularly offset with respect to one another at an angle of at least about 60 degrees, and preferably about 90 degrees.

According to another aspect, the invention provides a modular unit or "module" for an underground water management system, the modular unit comprising a polyhedral prism structure which encloses or encompasses at least two internal support members, wherein the internal support members comprise a first member having a first U-shaped profile and a second member having a second U-shaped profile, and wherein the first member and the second member are arranged such that the first U-shaped profile and the second U-shaped profile span or extend in planes which are offset at an angle with respect to one another. In this regard, the first U-shaped profile and second U-shaped profile preferably span or extend in planes which are angularly offset with respect to one another by an angle of at least about 60 degrees, and more preferably about 90 degrees.

In a preferred embodiment, one of the first U-shaped profile and the second U-shaped profile is inverted with respect to the other. In this regard, preferably one of the first U-shaped profile and the second U-shaped profile is configured and arranged as an arch and the other of the first and second U-shaped profiles is configured and arranged as an inverted arch. The internal support members preferably extend between a base of the prism structure and a top of the prism structure to bear and/or transmit load through the prism structure.

In at least one embodiment described herein, therefore, there is provided a module for use in underground water management systems, the module comprising an assembly of parts that form a prism, being a polyhedron, which encloses at least a pair of internal members, wherein the pair of internal members comprises a first member having a first arch and a second member having a second arch, wherein the first member and second member are arranged such that the first arch and second arch extend in planes which are at an angle, preferably 90 degrees, with respect to one another, and such that the second arch is inverted with respect to the first arch.

In a preferred embodiment, the modular unit or module comprises a plurality of panels which are interconnected to form the polyhedral prism structure. The plurality of panels includes a bottom panel, a plurality of side panels and a top panel, wherein the side panels are configured for connection with the bottom panel and/or the top panel, and wherein the internal (support) members are configured for connection with the base panel and/or with the top panel. Preferably, therefore, the bottom panel has a plurality of connection elements which are configured to receive and/or connect with complementary connection elements provided along edge regions of the side panels and/or along edge regions of the internal support members.

In a preferred embodiment, the plurality of connection elements of the bottom panel are arranged across a primary face of the bottom panel and preferably comprise a plurality of holes or apertures configured to receive and/or connect with complementary projections provided along edge regions of the side panels and/or along edge regions of the internal support members. Preferably, a peripheral edge of the bottom panel has a plurality of projections and recesses for interlocking engagement or interconnection with corresponding projections and recesses at a peripheral edge of an adjacent or adjoining bottom panel.

Preferably, a bottom panel of the modular unit or module, which forms a base of the prism structure, has at least three substantially co-planar side edges and is more preferably four-sided or five-sided or six-sided.

In at least one related embodiment, therefore, there is provided a module for use in an underground water management system, the module comprising a polygonal prism having multiple panels, wherein the panels define faces of the prism and enclose a pair of internal members, the internal members comprising a first member comprising an inverted arch, and a second member comprising an arch which is arranged to span the inverted arch.

Preferably, the panels defining faces of the polygonal prism may enclose two or more pairs of internal members. Preferably, the first member and second member are generally flat or 'planar' members and are arranged such that their primary planes are oriented substantially orthogonal with respect to one another. It will be understood that the term 'planar' used herein in this context means that the members are relatively flat with two major dimensions (e.g. height and width) that together define a primary plane of the member and a minor third dimension (e.g. depth) making the member relatively thin.

Preferably, the polygonal prism comprises multiple panels, and each panel is configured to interconnect and/or to interlock with one or more adjacent panels. It is also preferred that the pair of first and second internal members are adapted to interconnect and/or to interlock with one or more of the panels.

In further embodiments described herein, there is provided a module for use in underground water management systems, the module comprising:

- multiple panels, preferably rectangular panels, each of which is adapted to interconnect and/or to interlock with adjacent panels to form a polygonal prism;
- a pair of internal members comprising: a first internal member having three edges, each of which extends substantially at a right angle to a respective adjoining edge, and a fourth edge which defines a first arch; and a second internal member having three edges, each of which extends substantially at a right angle to a respective adjoining edge, and a fourth edge which defines a second arch;
- wherein the first and second internal members are configured and arranged to interconnect and/or interlock with the panels of the prism such that the first member and second member are substantially enclosed by the panels and such that one of the first arch and the second arch is inverted with respect to the other and extends in a plane that is at an angle, preferably 90 degrees, with respect to a plane of the other.

As mentioned above, it is preferred that the polyhedral prism is a rectangular prism having six faces, with a base or bottom panel having four orthogonal side edges. However, the invention includes other polyhedral prisms within its scope. Specifically, the present invention includes within its scope polyhedral prisms with a base or bottom panel having at least three generally co-planar side edges, but preferably having four, five, or six side edges.

Preferably, each panel is generally flat or 'planar' and generally rectangular, with the rectangular shape being defined by four orthogonal peripheral or side edges of the panel. Preferably two or more of the panel peripheral edges/side edges are adapted to interconnect and/or interlock with a corresponding edge of an adjacent panel. In order to keep the inventory of components for the module to a minimum, all of the panels may be of substantially identical size and shape. Alternatively, two different designs of panels may be used. For example, a rectangular prism may have top and bottom panels that are the same, e.g. square-shaped, and side panels that are all the same, e.g. rectangular shaped.

Preferably, each of the internal members is adapted at one or more edges thereof to interconnect and/or to interlock with an adjacent panel of the module. The first and second internal members may be of the same shape and configuration, but in use one is inverted relative to the other. Thus, the module of the invention can be assembled with as little as two different components (i.e. panels and internal members) or with three different components (i.e. end panels, side panels and internal members).

According to a further aspect, the invention provides modular system for use in underground water management, the modular system comprising a plurality of modules or modular units according to any of the embodiments of the invention described above.

In a preferred embodiment, the plurality of modules or the plurality of modular units of the modular system are designed or configured to be interconnected with one another, e.g. in a horizontal or side-by-side arrangement of the modules or modular units and/or in a vertical or stacked arrangement of the modules or modular units.

In a preferred embodiment, a top panel of one module or modular unit in a vertical or stacked arrangement thereof forms a bottom panel of the module or modular unit immediately above said one module or modular unit.

Similarly, in a preferred embodiment, a side panel of one module or modular unit in a horizontal or side-by-side arrangement thereof forms a side panel of the module or modular unit immediately adjacent to said one module or modular unit.

Method of Assembly

In another aspect of embodiments described herein, a method of assembling a module for use in an underground water management system is provided, the method comprising the steps of:

providing a first panel, interconnecting or interlocking a first internal member with the first panel such that an arch of the first internal member extends in a plane orthogonal to a primary plane of the first panel, interconnecting or interlocking a second internal member with the first panel such that an arch of the second internal member extends in a plane orthogonal to a primary plane of the first panel and offset at an angle to the plane of the arch of the first internal member, wherein the arch of the first internal member is inverted with respect to the arch of the second internal member, and interconnecting or interlocking second and subsequent or further panels to form a prism enclosing the first and second internal members.

In a particularly preferred embodiment, the panels are all of substantially the same size and shape and the rectangular prism is a cube. In another embodiment, two substantially flat or planar square-shaped panels form a top and bottom, respectively, of a rectangular prism, and four other, substantially flat or planar rectangular-shaped panels (i.e. of different length and width) form the sides of the prism.

In preferred embodiments, each of the panels has an 'open' configuration. In other words, each of the panels has an open structure comprising a plurality of openings or perforations, e.g. in the manner of a mesh or open framework. In this way, the panels are configured or adapted to allow the passage of water, small amounts of soil or small roots there-through. The specific configuration may differ for two or more of the panels.

In preferred embodiments, each of the internal members has an open structure or an open configuration comprising a plurality of openings or perforations, e.g. in the manner of a mesh or open framework. Thus, the internal members are preferably also configured or adapted to promote the passage of water, small amounts of soil or small roots there-through.

In preferred embodiments, the parts or components (i.e. panels and internal members) of the module are configured to be interconnected or interlocked permanently or reversibly in any convenient manner. For example, the interconnection or interlock may be mechanical, provided by form fit, snap fit, or interference fit between a projection provided on one part or component and a correspondingly shaped recess or hole on an adjacent part or component.

In a preferred embodiment, at least some of the panels are provided at their peripheral edges with alternating projections and recesses for interlocking engagement or interconnection with corresponding projections and recesses at the peripheral edges of an adjoining panel. The projections and recesses may, for example, have a generally square shape or preferably a trapezoidal shape. The projections of one panel may thus interconnect and/or interlock with the recesses in an adjacent panel and vice versa. This may, for example, form a 'dovetail' joint which is known for resilience, strength, and tight, long-lasting fit. This type of interlock is preferred over the simple slide fittings and the like that are relatively weak and are more easily broken.

Preferably, the panels forming the top and bottom of a module have multiple openings or holes in a grid formation. These openings or holes are preferably configured to receive interconnecting projections on the edges of the internal members.

Other aspects and preferred embodiments or preferred forms are disclosed in the specification and/or defined in the appended claims, forming a part of the description of the invention. In essence, embodiments of the invention incorporate the concept that a module comprising opposed, respectively inverted and angularly offset arches, provides both high strength for supporting elements above, in combination with a compact, open structure that can avoid hindering those elements and/or water passage below ground. Furthermore, the opposing arches form part of a system of interlocking panels that can be used to form either independent modules or a continuum of modules interconnected in a horizontal direction and/or a vertical direction.

Various advantages provided by the module of the present invention include:

improved strength and flexibility of design strength that can be readily adjusted by increasing or decreasing the number of opposing arched internal members, suitable for multiple purposes, including stormwater management (e.g. soak pit or stormwater detention), rainwater storage (e.g. underground water tank which can store water or be pumped out and re-used), and a structural soil support system, i.e. purposes other than water management, quick, simple and compact assembly of lightweight components to form individual modules or a more extensive module system, modular construction allows design and assembly of a wide variety of shapes and sizes providing flexibility to fit in a range of different spaces, including tight spots, discrete, individual modules or a system of interconnected modules, modules can be constructed from a minimal number of different components (e.g. two or three) to reduce stock inventory and storage space, modules can be fabricated from recycled polymer, modules are easily flushed-out when used for stormwater management, large, open structure with internal void permits free flow of water to prevent build-up of debris and/or to provide space for root growth.

Some of the applications for which the modular units, the modular system, and method of the present invention are suitable include:

stormwater management, including use in a soak pit (e.g. when wrapped in geo-textiles), or device for general stormwater detention or rainwater harvesting, green roof drainage and planter box drainage, structural soil support and provision of growth areas around trees, load support for landscaping structures, such as boulders, and civil engineering structures, such as pavements and playground equipment.

Further scope of applicability of embodiments of the present invention will become apparent from the detailed description given hereinafter. However, it should be understood that the detailed description and specific examples, while indicating preferred embodiments of the invention, are given by way of illustration only, since various changes and modifications within the spirit and scope of the disclosure herein will become apparent to those skilled in the art from this detailed description.

BRIEF DESCRIPTION OF THE DRAWINGS

For a more complete understanding of the invention and advantages thereof, exemplary embodiments of the invention are explained in more detail in the following description with reference to the accompanying drawing figures, in which like reference signs designate like parts and in which.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will also be understood that certain actions and/or steps in an embodiment of a method may be described or depicted in a particular order of occurrences while those skilled in the art will understand that such specificity with respect to sequence is not actually required.

DETAILED DESCRIPTION

Figure 1:
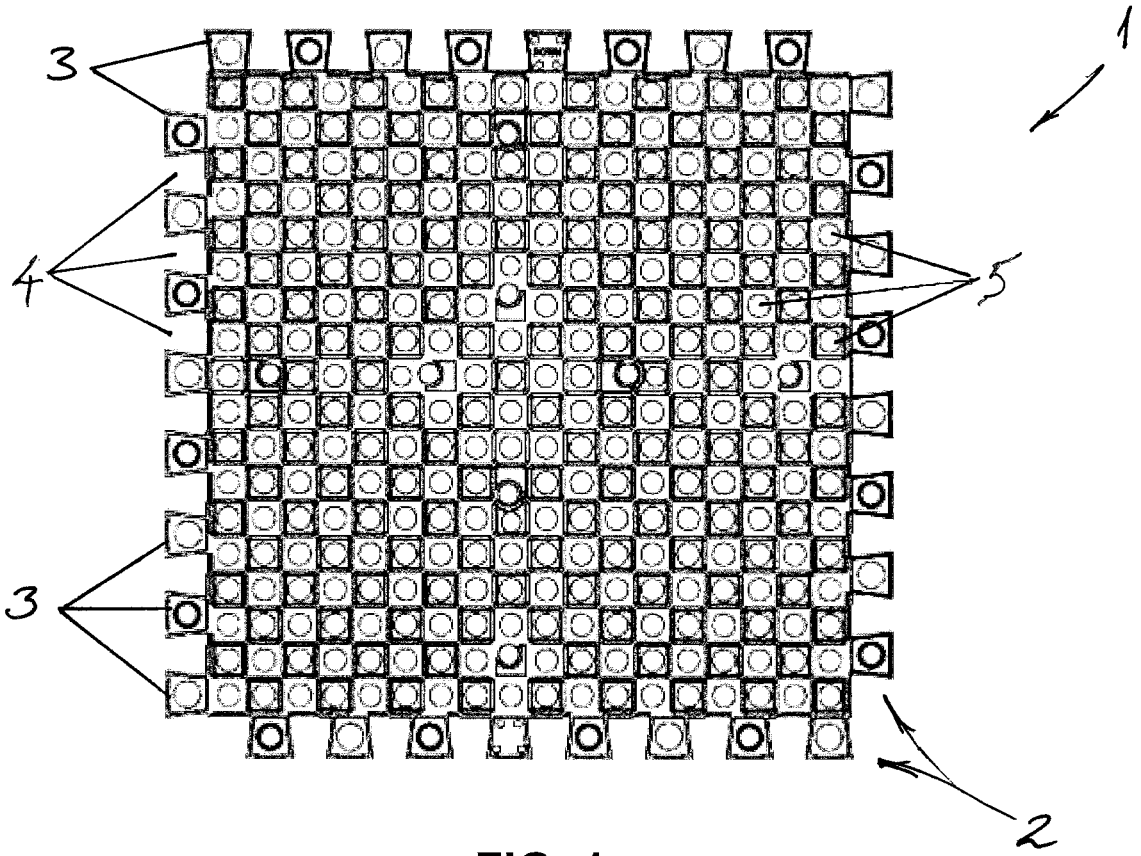
FIG. 1 illustrates a plan view of an embodiment of a panel for a module according to a preferred embodiment of the invention in a configuration suitable for use as a top panel or a bottom panel of the module formed as a rectangular prism.
Figure 7:
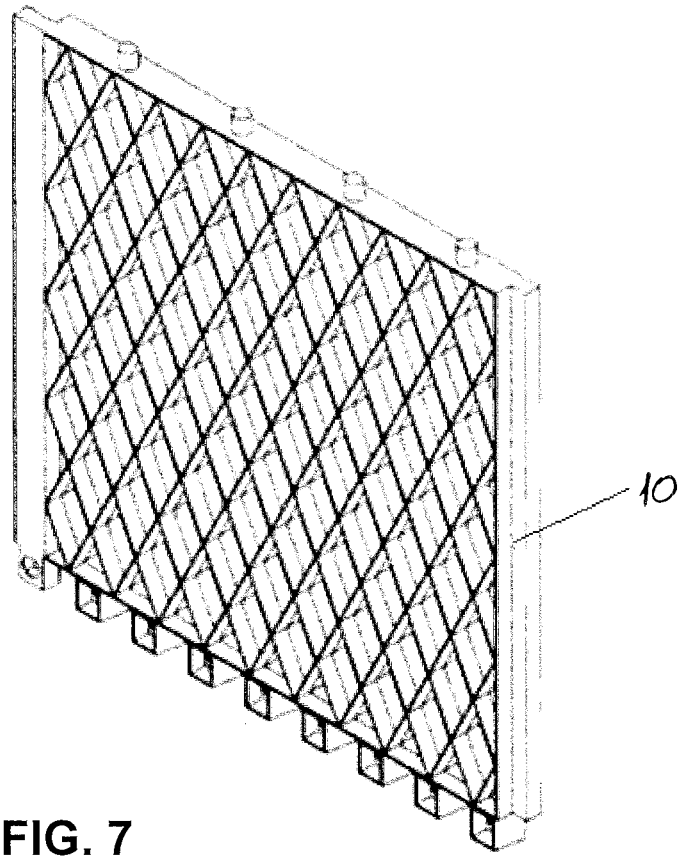
FIG. 7 illustrates a perspective view of the panel of FIG. 5, viewed from one edge.

With reference firstly to FIG. 1 through to FIG. 7 of the drawings, the various component parts of a modular unit or module according to a preferred embodiment of the invention are illustrated. In the particular embodiment shown, the component parts of the module are substantially square and flat or 'planar', however it will be appreciated that the module is not so limited and may include component parts of other shapes and configurations. The component parts may preferably be manufactured as monolithic or unitary parts moulded from a robust polymer plastic material, such as polyethylene (PE), e.g. LDPE or HDPE, polypropylene (PP), polyvinyl chloride (PVC), polyurethane (PU) or other such materials. These component parts may be manufactured from virgin polymer plastic material, but optionally also from a recycled polymer plastic material.

Figure 2:
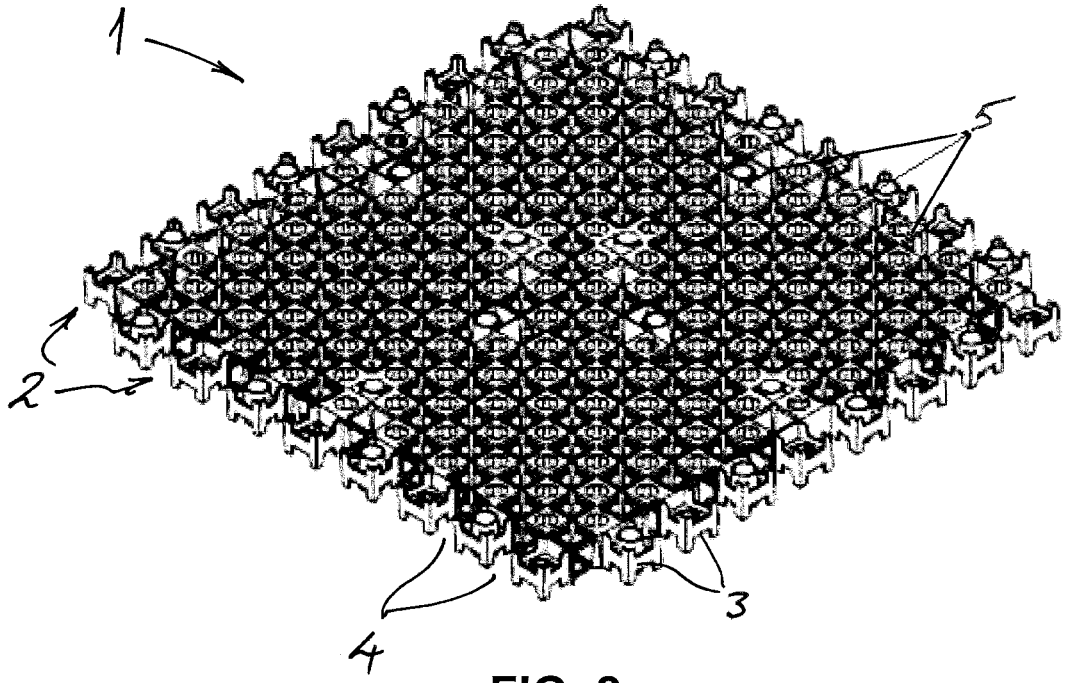
FIG. 2 illustrates a perspective view of the panel of FIG. 1, showing the rectangular (e.g. generally square) planar face of the panel viewed from one corner.

FIG. 1 and FIG. 2 illustrate a panel 1 with a generally rectangular (square) face viewed from above (FIG. 1) and in perspective view (FIG. 2). This specific configuration is preferred for use as a top panel or a bottom panel of a rectangular module 20. Typically, the panel 1, when used as a top panel or bottom panel of a module 20, would have a thickness in the range of about 25 mm to 40 mm. A peripheral edge 2 of the panel 1 defines a series of alternating trapezoidal projections 3 and corresponding recesses 4 for interlocking engagement or interconnection with corresponding projections and recesses 3, 4 at the peripheral edges 2 of an adjoining panel 1 to form a 'dovetail' joint known for strength and a long-lasting fit. The panel 1 further includes a plurality of circular holes 5 therethrough across the generally planar face of the panel 1. These holes or openings 5 are, on the one hand, configured or adapted to allow passage of water, small amounts of soil or small roots there-through. On the other hand, the holes or openings 5 are adapted to receive complementary rounded or cylindrical projections 8 provided along edges 7 of internal support members 6, 6' of the module 20 shown in FIGS. 3A and 3B and FIGS. 4A and 4B. In this manner, the internal support members 6, 6' can be readily located and secured in position with respect to the panel 1.

Figure 3A:
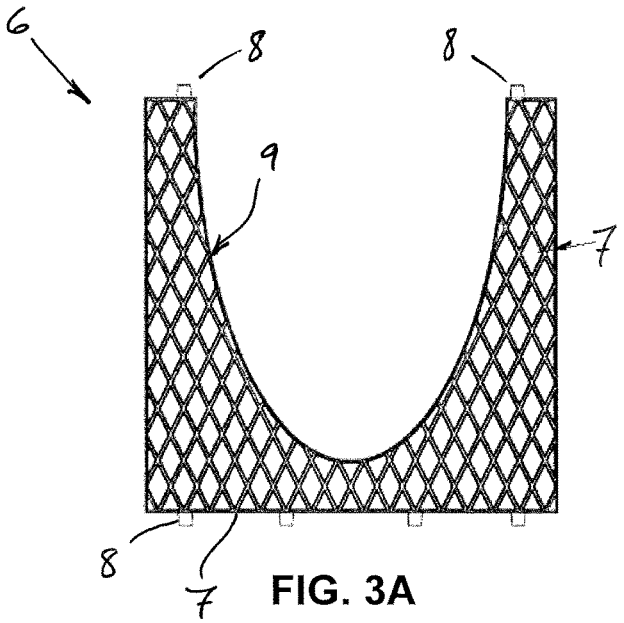
FIG. 3A illustrates a front view of an embodiment of a first internal member for a module according to a preferred embodiment of the invention, the first internal member oriented to provide an inverted arch.
Figure 3B:
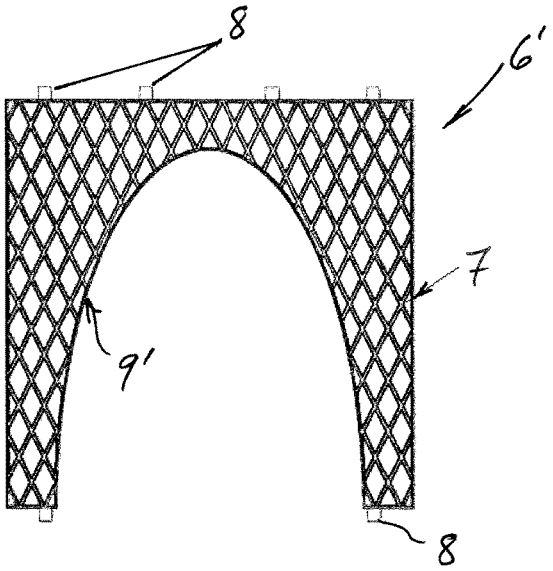
FIG. 3B illustrates a front view of an embodiment of a second internal member oriented to provide an arch.
Figure 4A:
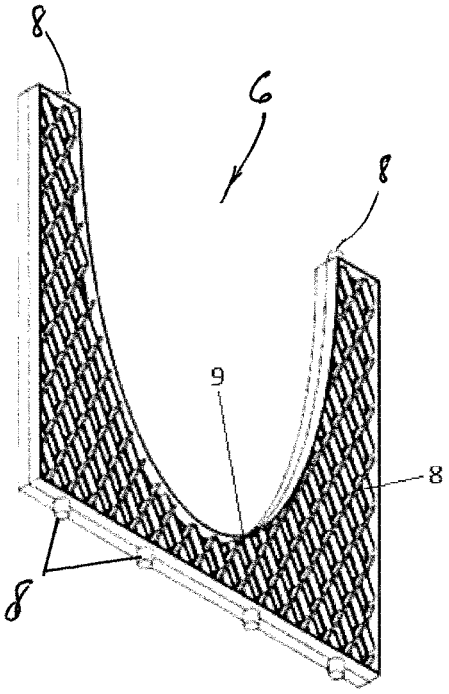
FIG. 4A illustrates a perspective view of the first internal member of FIG. 3A from one edge and FIG. 4B illustrates a perspective view of a second internal member of FIG. 3B from one edge.
Figure 4B:
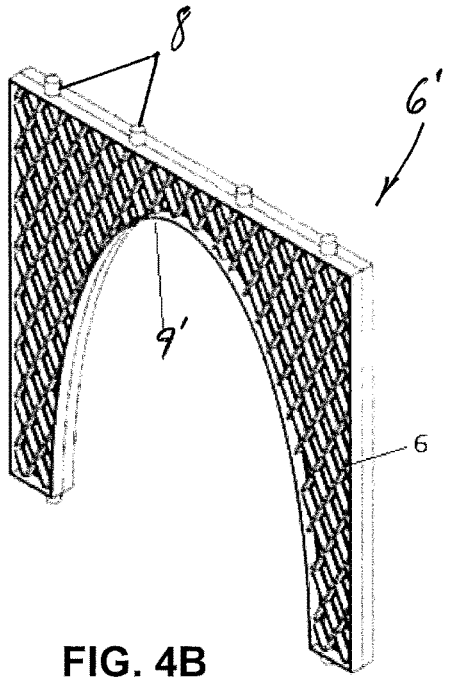

FIGS. 3A and 3B and FIGS. 4A and 4B illustrate a first internal member 6 and a second internal member 6' in both front and perspective views. These first and second internal members 6, 6' have an open structure with a multiple diamond shaped openings. FIG. 3A and FIG. 4A depict the first planar member 6 with a U-shaped profile oriented to provide an inverted arch 9, whereas FIG. 3B and FIG. 4B depict the same structure but inverted vertically (i.e. upside down) as a second internal member 6' with a U-shaped profile oriented to provide an arch 9'. As illustrated, these first and second internal members 6, 6' are substantially flat or planar members and are generally of the same shape and configuration, but in use one is inverted with respect to the other. This enables the production of the module 20 with as little as only two or three different component parts. Each internal member 6, 6' is adapted at two or more of its edges 7 to interconnect or interlock with an adjacent base panel 1 or top panel. That is, the round projections 8 on the peripheral edges 7 of the planar internal member 6, 6' is received in a form fit and/or a friction fit in the respective holes 5 in the top and bottom panels 1 of the module 20. The body of these top and bottom planar face panels include multiple holes 5 in a grid formation, the holes being of complementary shape to the projections 8 on the edges 7 of each of the internal members 6, 6'.

Figure 5:
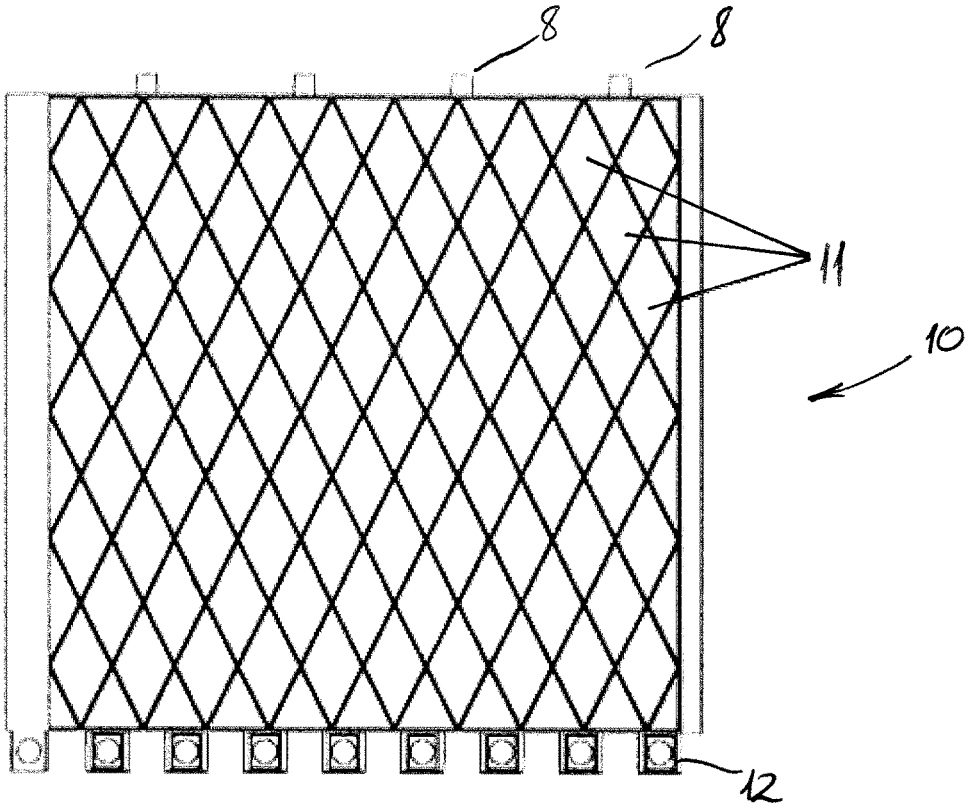
FIG. 5 illustrates a front view of an embodiment of a panel for a module according to a preferred embodiment of the invention having a configuration suitable for use as a side panel of a module formed as a rectangular prism.
Figure 6:
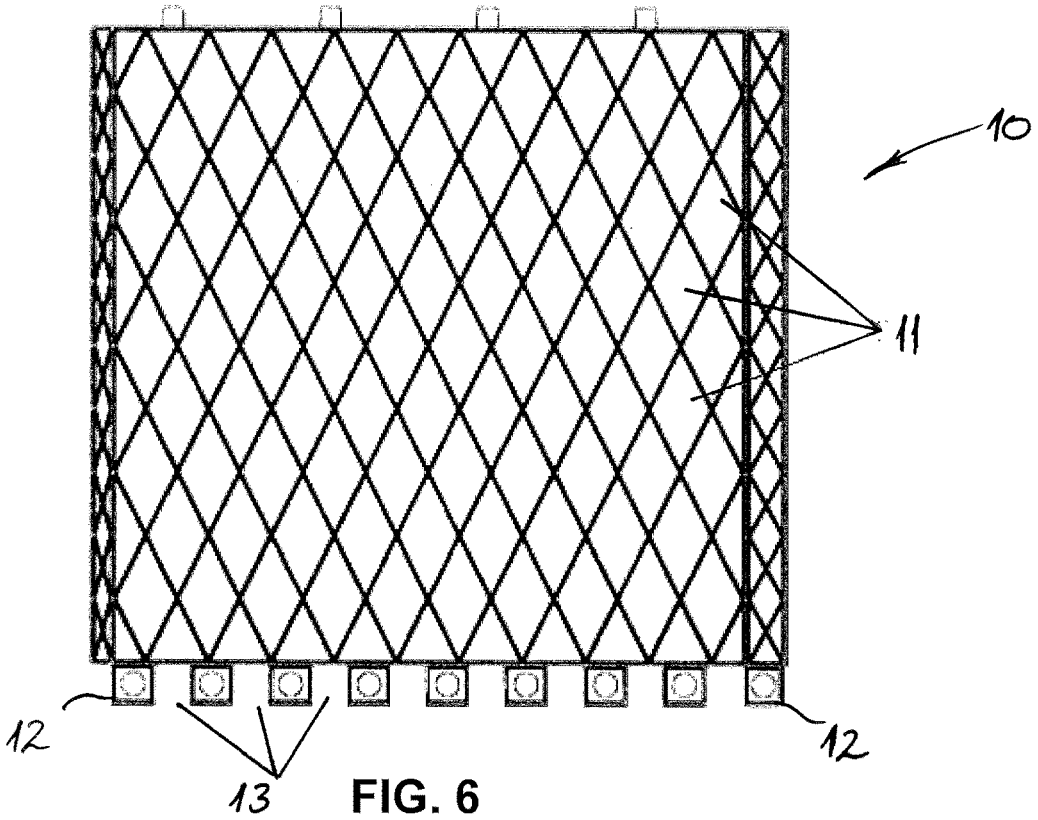
FIG. 6 illustrates a reverse view of the panel of FIG. 5 showing its rectangular planar face.

FIG. 5, FIG. 6 and FIG. 7 illustrate another panel 10 of the module 20 from the front (FIG. 5), from the rear (FIG. 6) and in perspective view (FIG. 7). The configuration of this panel 10 is preferred for use as a side panel of the module—i.e. to form a side face of a rectangular prism formed by the module 20. The body of the panel 10 has an open structure comprising a plurality of diamond shaped openings 11, e.g. in the manner of an open framework. In this way, these panels 10 are configured or adapted for the passage of water, small amounts of soil or small roots there-through. The panels 10 illustrated in FIG. 5 to FIG. 7 are provided at their peripheral edges with a series of alternating square projections 12 and square recesses 13. The projections 12 of one side panel 10 can thus interconnect or interlock with the recesses 13 in an adjacent side panel 10 and/or with complementary recesses provided in an adjacent top or bottom panel 1 to form a joint that is strong, robust and long-lasting.

FIG. 8 to FIG. 13 illustrate the preferred steps taken to assemble a first module 20 and then assemble a second module 20' on top of the first module.

More particularly, the module 20 of the invention comprises a prism structure being a polyhedron enclosing or encompassing a pair of internal support members 6, 6', a first member 6 comprising a first (inverted) arch 9, and a second member comprising a second arch 9' located at an angle to and being arranged inverted with regard to the first arch 9. While the drawing figures depict a polyhedral prism structure having four sides—i.e. bottom panel 1 has four orthogonal edges 2—the invention includes other polyhedral prisms within its scope. Specifically, the invention includes within its scope polyhedral prisms having a bottom panel with at least three co-planar edges, but preferably four, or five or six edges.

The modules 20 can be used as independent modular units, or they can form an interconnected system 100 of any desired dimension or configuration. The modules can be quickly and simply assembled and installed without the need for special training or tools.

Figure 8:
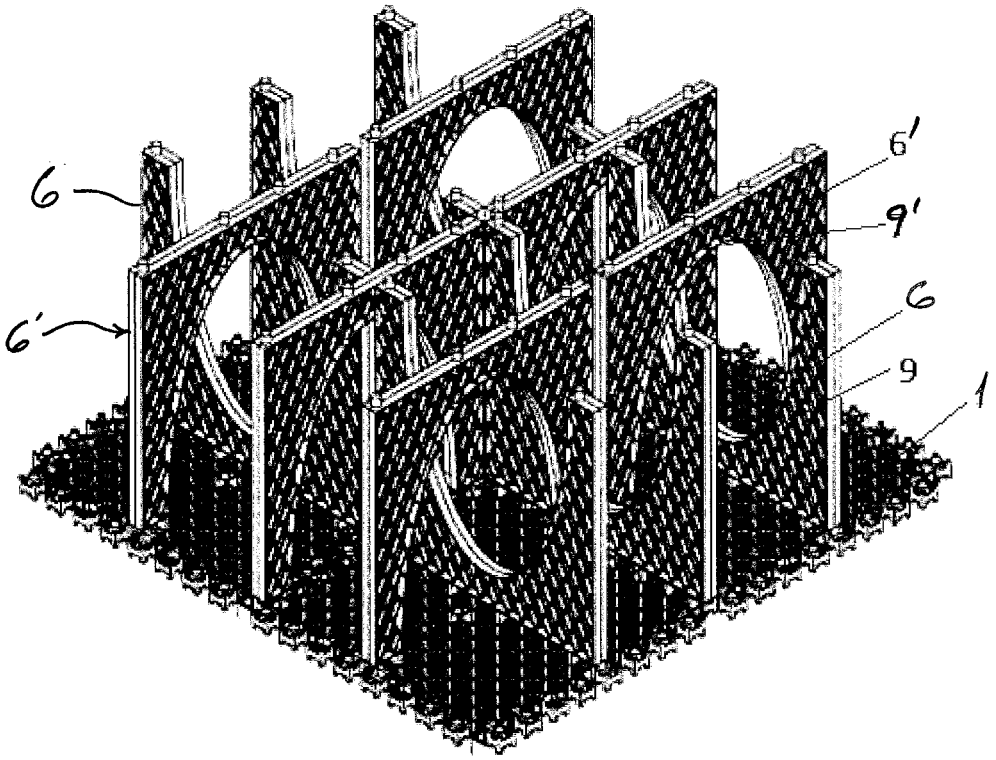
FIG. 8 illustrates a perspective view of pairs of the internal members of FIG. 3A and FIG. 3B interconnected or interlocked with the panel of FIG. 1 acting as a base or bottom panel of the module. In this view, a plane of the arch of the second internal member is clearly seen angularly offset by 90 degrees from, to intersect and span across, a plane of the inverted arch of the first internal member.

FIG. 8 illustrates four pairs of internal members 6, 6' of FIG. 6 interlocked with the panel 2 of FIG. 1 acting as the bottom of the module. In this view, the arches 9' can be clearly seen to span across the inverted arches 9, extending in planes angularly offset by about 90 degrees. In this particular embodiment, it will be noted that four additional internal support members 6, 6' are included that are not individually paired to have corresponding opposed arches. In some modules it may be preferable to include these further arched internal members to increase the module strength if it is supporting a particularly heavy above ground structure.

Figure 9:
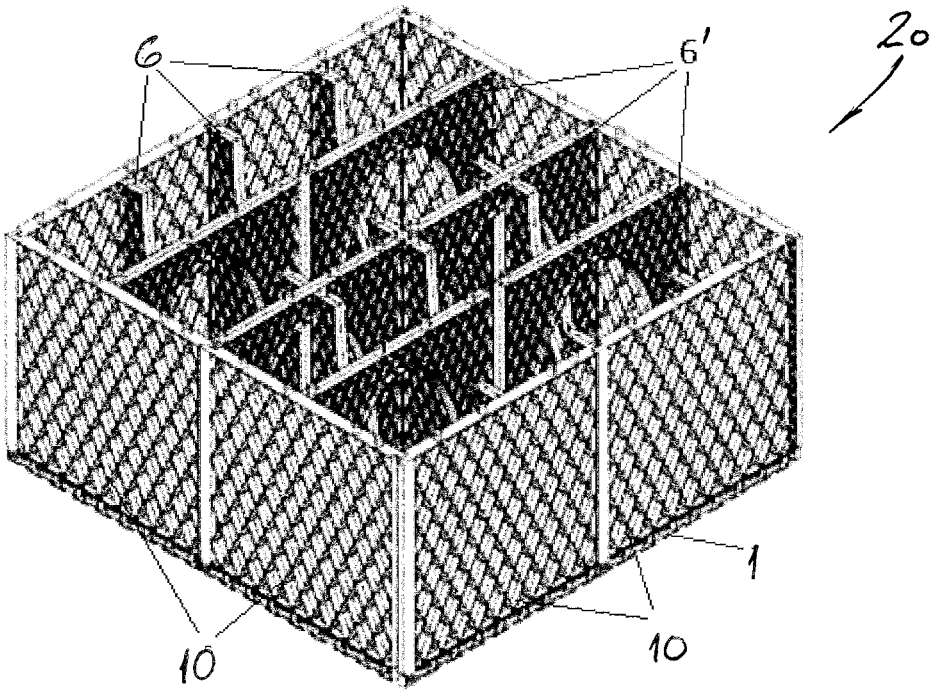
FIG. 9 illustrates a perspective view of the internal structure of FIG. 8 in a module with rectangular planar panels interconnected or interlocked around a periphery of the base panel of FIG. 1 to create the side faces of the module.

FIG. 9 illustrates the structure of FIG. 8 with multiple panels 4 added to create the sides of the module.

Figure 10:
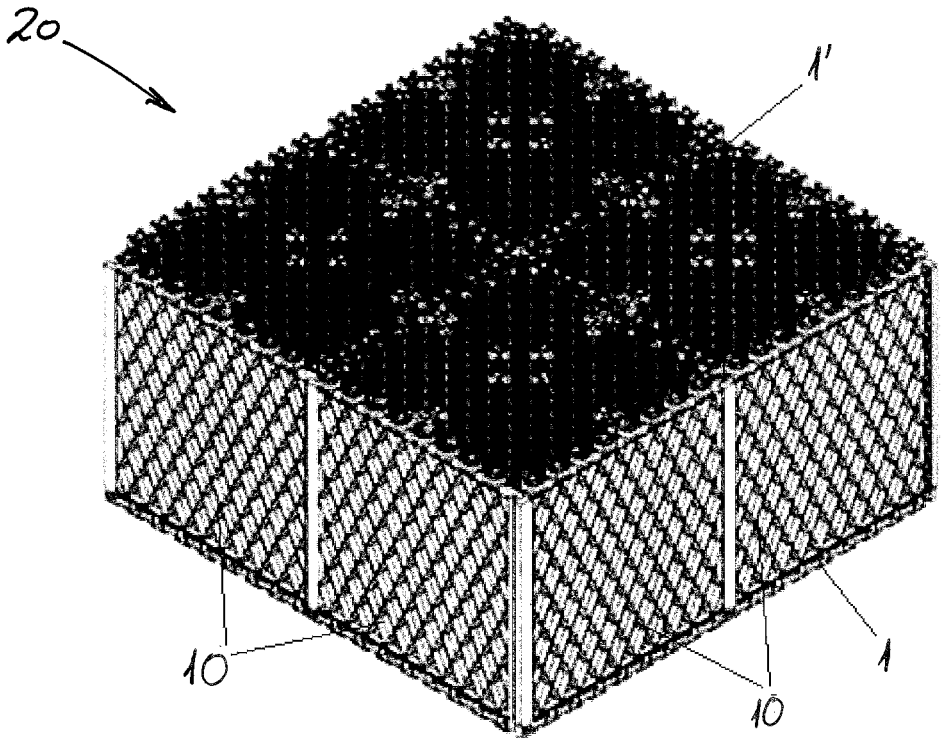
FIG. 10 illustrates a perspective view of the arrangement of FIG. 9 with a top panel added to complete the module. The top panel may act as the bottom panel of a further module added on top.

FIG. 10 illustrates the structure of FIG. 9 with a panel 1' added to act as the top, thus completing the first module. Projections on the edges of the internal members 6, 6' and the side panels 4 interlock with holes in the top panel. The rectangular planar face of the top panel 1' may also act as the base or bottom panel 1 of any further module 20' added or assembled on top.

Figure 11:
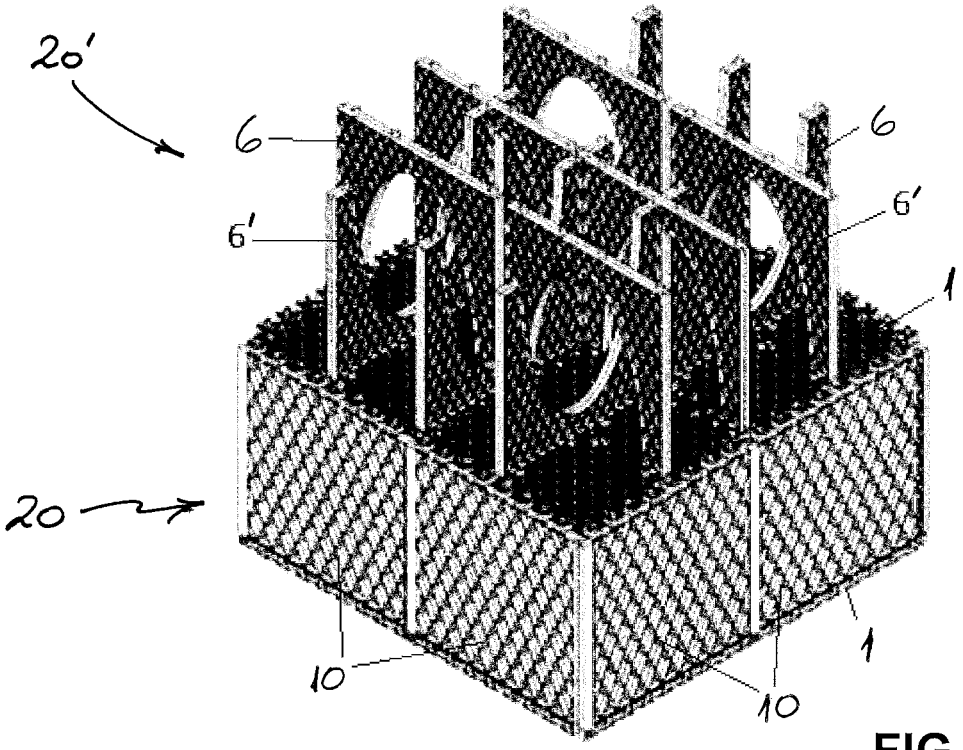
FIG. 11 illustrates a perspective view of the module of FIG. 10 with further pairs of internal members interconnected or interlocked with the top panel to start the assembly of a second module vertically on top of the first module.

FIG. 11 illustrates the first module of FIG. 10 with pairs of internal members 6, 6' added to start the assembly of a second module on top of the first module.

Figure 12:
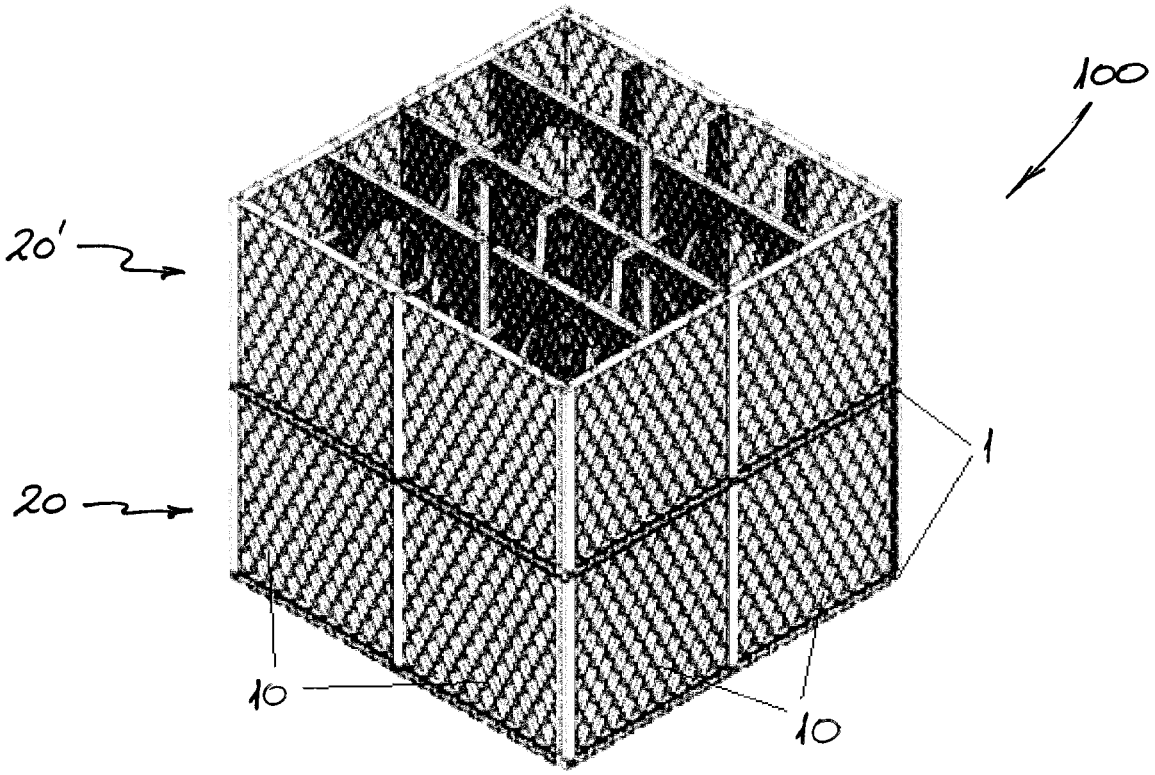
FIG. 12 illustrates a perspective view of the arrangement of FIG. 11 with multiple rectangular planar panels added interconnected or interlocked around a periphery to create the side faces of the second module.

FIG. 12 illustrates the structure of FIG. 11 with multiple rectangular panels 10 added to create the sides of the second module 20'.

Figure 13:
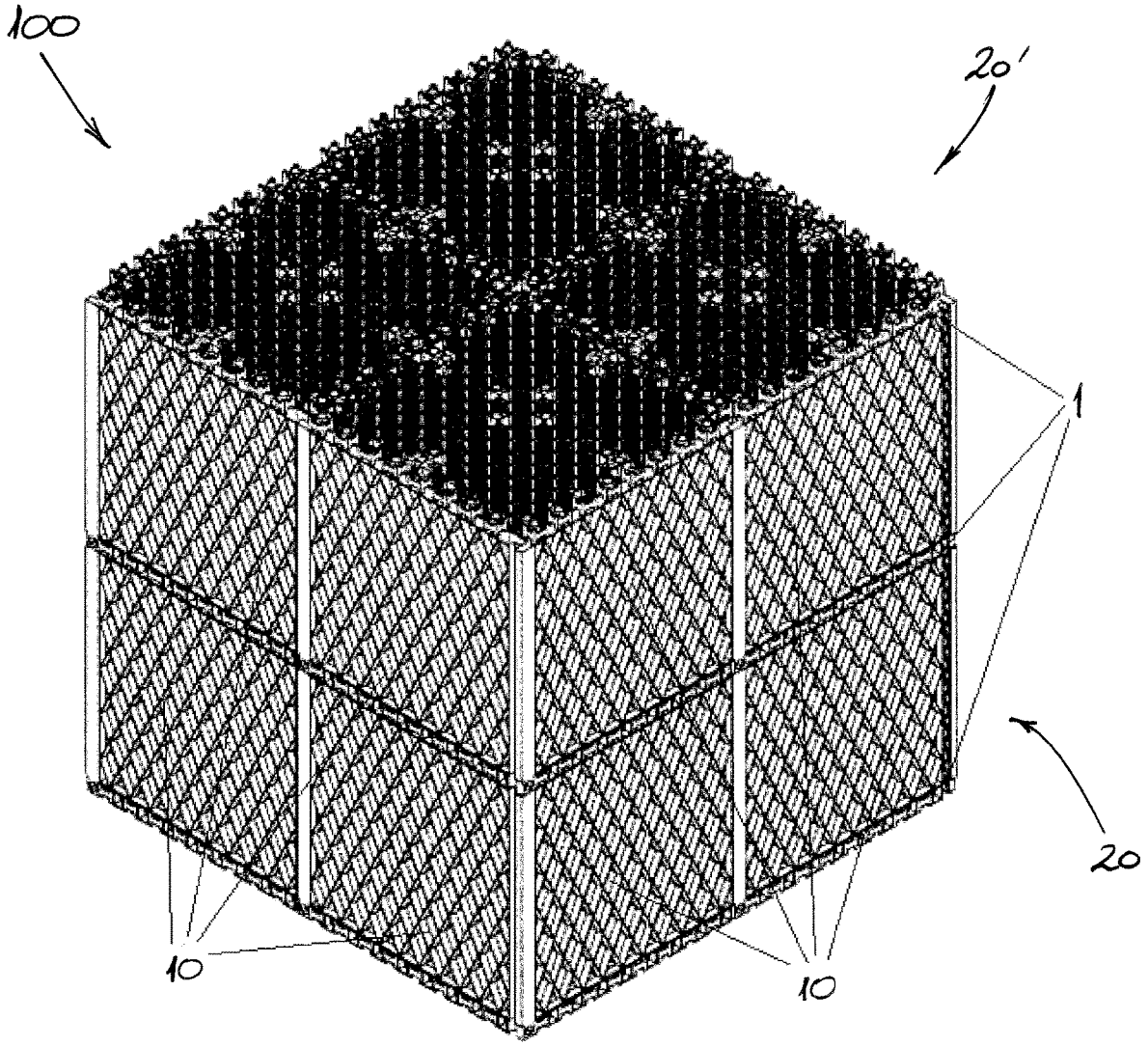
FIG. 13 illustrates a perspective view of the arrangement of FIG. 12 with a panel added to act as the top of the second module.

FIG. 13 illustrates the structure of FIG. 12 with a rectangular panel 1' added to act as the top of the second module.

Figure 14:
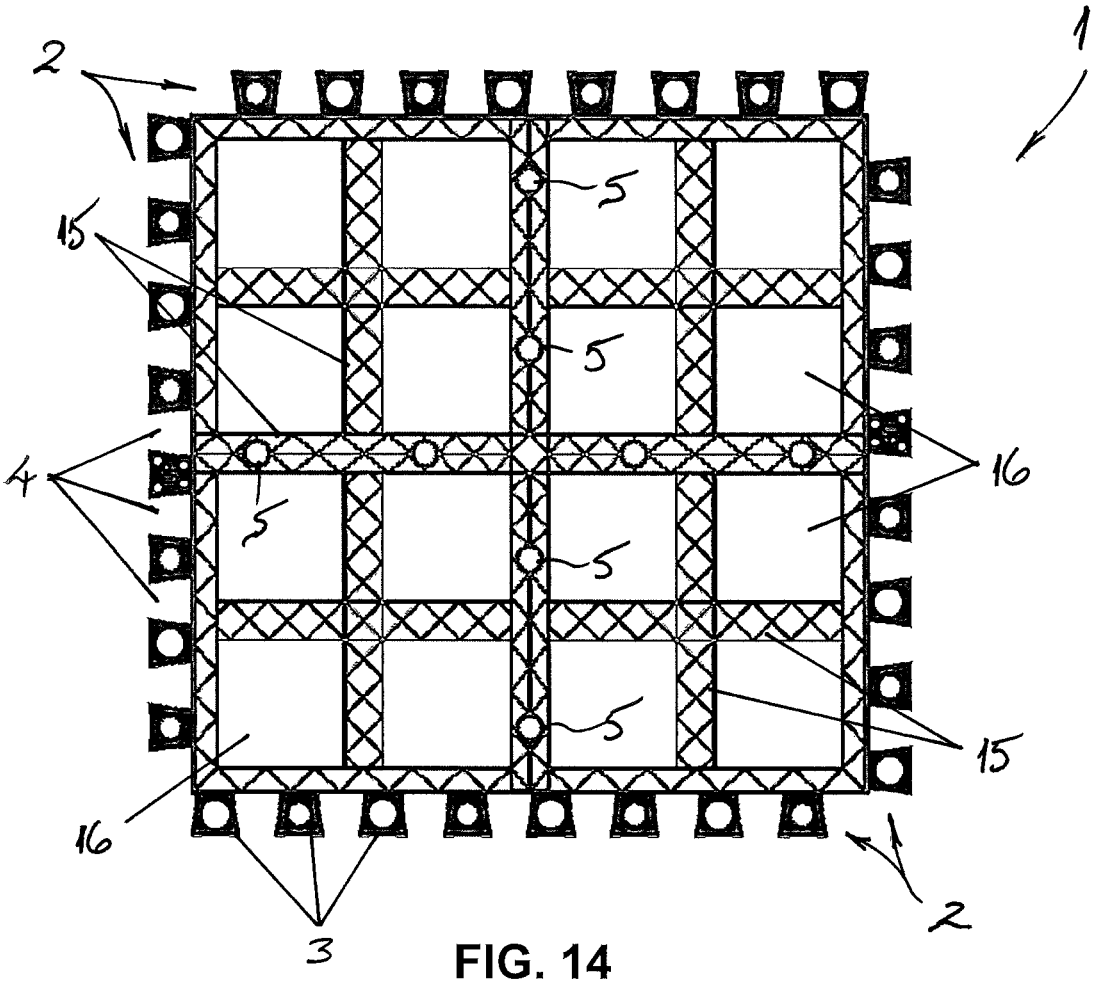
FIG. 14 illustrates a plan view of a further embodiment of a panel for a module according to another preferred embodiment of the invention in a configuration for use as a top panel or a bottom panel of a module formed as a rectangular prism.

FIG. 14 illustrates a plan view of another embodiment of a panel 1 for use as a bottom panel or a top panel in a rectangular prism structure of a module 20 according to another preferred embodiment of the invention. In this example, the panel 1 is formed as an open grid or framework of crossed elongate elements 15 defining square apertures 16 which are significantly larger than the individual openings or perforations in the example of the panel 1 shown in FIG. 1, e.g. for easier water passage. Nevertheless, the panel 1 of FIG. 14 still includes holes or openings 5 are adapted to receive and connect with the complementary projections 8 on the edges 7 of internal support members 6, 6'. The peripheral edge 2 of the panel 1 again comprises a series of trapezoidal projections 3 and corresponding recesses 4 for interlocking engagement or interconnection with the complementary projections and recesses 3, 4 at the peripheral edge 2 of an adjoining panel 1 in a 'dovetail' joint, as described above with regard to FIG. 1.

The invention has been described in connection with specific embodiments but as will be understood, it is capable of further modification(s). This application is intended to cover any variations uses or adaptations of the invention following, in general terms, the principles of the invention and including such departures from the present disclosure as come within known or customary practice within the art to which the invention pertains and as may be applied to the essential features hereinbefore set forth.

Thus, although specific embodiments of the invention are illustrated and described herein, it will be appreciated by persons of ordinary skill in the art that a variety of alternative and/or equivalent implementations exist. It should be appreciated that each exemplary embodiment is an example only and is not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of parts or elements described in an exemplary embodiment without departing from the scope as set forth in the appended claims and their legal equivalents. Generally, this application is intended to cover any adaptations or variations of the specific embodiments discussed herein.

Thus, various modifications and equivalent arrangements to those described above with reference to the drawings are intended to be included within the spirit and scope of the invention and appended claims. Therefore, the specific embodiments are to be understood to be illustrative of the many ways in which the principles of the invention may be practiced. In the following claims, means-plus-function clauses are intended to cover structures that perform the defined function and not only structural equivalents, i.e. also functionally equivalent structures.

For the purposes of description herein, it will be noted that the terms "upper", "lower", "top", "bottom", "right", "left", "rear", "front", "vertical", "horizontal", "interior", "exterior", as well as variants or derivatives thereof, shall relate to the invention and its components as oriented in FIG. 10. However, it is to be understood that the invention may assume various alternative orientations, except where expressly specified to the contrary. It is also to be understood that the specific devices and processes illustrated in the attached drawings and described above are simply exemplary embodiments of the concepts defined in the appended claims. Hence, specific dimensions and other physical characteristics relating to the embodiments disclosed herein are not to be considered as limiting, unless the claims expressly state otherwise. Further, unless otherwise stated, it is to be understood that discussion of a particular feature of component extending in or along a given direction or the like does not mean that the feature or component follows a straight line or axis in such a direction or that it only extends in such direction or on such a plane without other directional components or deviations, unless otherwise specified.

It will also be appreciated that the terms "comprise", "comprising", "include", "including", "contain", "containing", "have", "having", and any variations thereof, used in this document are intended to be understood in an inclusive (i.e. non-exclusive) sense, such that the module, method, device, apparatus, or system described herein is not limited to those features, integers, parts, elements, or steps recited but may include other features, integers, parts, elements, or steps not expressly listed and/or inherent to such module, method, device, apparatus, or system. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects. In addition, reference to positional terms, such as "lower" and "upper", used in the above description are to be taken in context of the embodiments depicted in the figures, and are not to be taken as limiting the invention to the literal interpretation of the term but rather as would be understood by the skilled addressee in the appropriate context.

The invention claimed is:

1. A modular unit for an underground water management system, the modular unit comprising a polyhedral prism structure which encloses or encompasses at least a pair of internal support members, wherein the internal support members comprise a first member having a first U-shaped profile and a second member having a second U-shaped profile, and wherein the first member and the second member are arranged such that one of the first U-shaped profile and the second U-shaped profile is inverted with respect to the other and such that the first U-shaped profile and the second U-shaped profile respectively extend in planes that intersect and are offset at an angle with respect to one another.

2. A modular unit according to claim 1, wherein the internal support members extend between a base of the prism structure and a top of the prism structure to bear load and/or transmit load through the prism structure.

3. A modular unit according to claim 1, wherein one of the first U-shaped profile and the second U-shaped profile is configured and arranged as an arch and the other of the first and second U-shaped profiles is configured and arranged as an inverted arch.

4. A modular unit according to claim 1, wherein the first U-shaped profile and the second U-shaped profile end in planes which are offset at an angle, of at least about 60 degrees with respect to one another.

5. A modular unit according to claim 1, comprising a plurality of panels members which are interconnected to form the polyhedral prism structure, the plurality of panel members including a bottom panel and a plurality of side panels, wherein the side panels are configured for connection with the bottom panel, and wherein the internal support members are configured for connection with the base panel and/or with a top panel.

6. A modular unit according to claim 5, wherein the bottom panel has a plurality of connection elements configured to receive and/or connect with complementary connection elements provided along edge regions of the side panels and/or along edge regions of the internal support members.

7. A modular unit according to claim 6, wherein the plurality of connection elements of the bottom panel are arranged across a primary face of the bottom panel and comprise a plurality of holes or apertures configured to receive and/or connect with complementary projections provided along edge regions of the side panels and/or along edge regions of the internal support members.

8. A modular unit according to claim 5, wherein a peripheral edge of the bottom panel has a plurality of projections and recesses for interlocking engagement or interconnection with corresponding projections and recesses at the peripheral edges of an adjacent or adjoining bottom panel.

9. A modular unit according to claim 5, wherein each of the panels comprises a plurality of openings or perforations to allow the passage of water, small amounts of soil, and/or small roots there-through.

10. A modular unit according to claim 1, wherein the first U-shaped profile and the second U-shaped profile are arranged to extend in planes that are offset at an angle of about 90 degrees with respect to one another.

11. A modular unit according to claim 1, wherein the first U-shaped profile and the second U-shaped profile span across or extend across one another.

12. A modular system for use in underground water management, the modular system comprising a plurality of modular units, each said modular unit comprising a polyhedral prism structure which encloses or encompasses at least a pair of internal support members, wherein the internal support members comprise a first member having a first U-shaped profile and a second member having a second U-shaped profile, and wherein the first member and the second member are arranged such that one of the first U-shaped profile and the second U-shaped profile is inverted with respect to the other, and such that the first U-shaped profile and the second U-shaped profile extend in planes that intersect and are offset at an angle with respect to one another.

13. A modular system according to claim 12, wherein the plurality of modular units are configured to be interconnected with one another in a horizontal or side-by-side arrangement of the modular units and/or in a vertical or stacked arrangement of the modular units.

14. A modular system according to claim 13, wherein a top panel of one modular unit in a vertical or stacked arrangement of the modular units forms a bottom panel of the modular unit immediately above said one modular unit.

15. A modular system according to claim 13, wherein a side panel of one modular unit in a horizontal or side-by-side arrangement of the modular units forms a side panel of the modular unit immediately adjacent to said one modular unit.

16. A modular system according to claim 12, wherein the first U-shaped profile and the second U-shaped profile span across or extend across one another.

17. A modular system according to claim 12, wherein the first U-shaped profile and second U-shaped profile are arranged to extend in planes that are offset at an angle of at least about 60 degrees with respect to one another.

18. A module for an underground water management system, the module comprising a prism being a polyhedron enclosing or encompassing at least a pair of internal members, wherein the internal members comprise a first member comprising a first arch, and a second member comprising a second arch offset at an angle of about 90 degrees to, and being arranged inverted with respect to, the first arch.

19. A module according to claim 18, wherein the first arch and the second arch span across or extend across one another.

20. A module for an underground water management system, the module comprising an assembly of panels to form a polygonal prism, the prism enclosing a pair of internal members, wherein the pair of internal members include a first member comprising an inverted arch, and a second member comprising an arch which is arranged to span or extend across the inverted arch.

21. A module according to claim 20, wherein the inverted arch of the first member and the arch of the second member are arranged to extend in planes that are offset at an angle of about 90 degrees with respect to one another.

22. A module for use in an underground water management system, the module comprising:

multiple panels, each adapted to interlock or interconnect with adjacent ones of said panels to form a polygonal prism structure; and at least two internal members comprising: a first internal member having three orthogonal edges and a fourth edge defining an inverted arch; and a second internal member having three orthogonal edges and a fourth edge defining an arch;

wherein the first and second internal members are adapted to interlock with the panels of the prism such that the arch is orthogonal to and spans across the inverted arch.

23. A module according to claim 22, wherein each of the multiple panels is a rectangular panel.

24. A method of assembling a module for use in an underground water management system, the method comprising steps of:

providing a first panel, interconnecting a first internal member having three orthogonal edges and a fourth edge defining an inverted arch with the first panel such that the inverted arch is orthogonal to the first panel, interconnecting a second internal member having three orthogonal edges and a fourth edge defining an arch to the first panel such that the arch is orthogonal to the first panel and spans across the inverted arch, interlocking second and subsequent panels to form a prism enclosing the first and second internal members.

* * * * *